US005089360A

United States Patent [19]

Kanno et al.

[11] Patent Number: 5,089,360

[45] Date of Patent: Feb. 18, 1992

[54] HIGH-STRENGTH NON-WOVEN FABRIC, METHOD OF PRODUCING SAME AND BATTERY SEPARATOR CONSTITUTED THEREBY

[75] Inventors: Tomoaki Kanno, Hadano; Yoshihisa Matsushima; Makoto Suzuki, both of Yokohama, all of Japan

[73] Assignee: Tonen Chemical Corporation, Tokyo, Japan

[21] Appl. No.: 651,832

[22] Filed: Feb. 7, 1991

[30] Foreign Application Priority Data

Feb. 8, 1990 [JP] Japan ..... 2-29034
Feb. 8, 1990 [JP] Japan ..... 2-29035

[51] Int. Cl.[5] ..... H01M 2/16

[52] U.S. Cl. ..... 429/254; 429/246; 428/296; 428/288

[58] Field of Search ..... 429/254, 246

[56] References Cited

U.S. PATENT DOCUMENTS 3,914,501 10/1975 Miller et al. ..... 429/254
4,315,062 2/1982 Clarizio ..... 429/246

*Primary Examiner*—Brian E. Hearn
*Assistant Examiner*—M. Nuzzolillo
*Attorney, Agent, or Firm*—Armstrong, Nikaido, Marmelstein, Kubovcik & Murray

[57] ABSTRACT

The high-strength non-woven fabric comprises 100 parts by weight of a non-woven fabric having an apparent fiber diameter of 0.1–15 μm; and 0.3–10 parts by weight of an N-methylol or N-alkoxymethyl nylon resin applied to the non-woven fabric, the N-methylol or N-alkoxymethyol nylon resin being cross-linked. The high-strength non-woven fabric has high mechanical strength with small maximum pore diameter. It is suitable for battery separators.

10 Claims, 2 Drawing Sheets

(a)

(b)

HIGH-STRENGTH NON-WOVEN FABRIC, METHOD OF PRODUCING SAME AND BATTERY SEPARATOR CONSTITUTED THEREBY

BACKGROUND OF THE INVENTION

The present invention relates to a high-strength non-woven fabric constituted by fine fibers and a method of producing it. The present invention also relates to a battery separator constituted by such a high-strength non-woven fabric, which shows a small electric resistance.

There are various batteries having different output voltages depending upon the combinations of metals and active materials used for both electrodes, electrolytes, etc.

Recently, attempts have been made to make batteries, particularly those using aqueous electrolytic solutions with higher performance, longer service lives and higher capacities. In connection with this tendency, battery separators are required to have higher capability of retaining an electrolytic solution and excellent capability of preventing electrode active materials particles from penetrating therethrough, with smaller thickness.

As such battery separators having various properties, non-woven fabrics made of thermoplastic resins have been attracting attention.

Such non-woven fabrics are usually produced by a dry method, a wet method and a spun bonding method, etc. However, all of the above methods fail to produce non-woven fabrics consituted by extremely fine fibers which can satisfy recent demands. Also, since these non-woven fabrics do not have sufficiently small port diameters, they do not have good capability of preventing electrode active materials particles from penetrating therethrough. In addition, it is not easy to produce extremely thin non-woven fabrics by these methods.

In these circumstances, attention has been paid to a non-woven fabric produced by a so-called "melt blowing method," in which a molten thermoplastic resin is ejected through a lot of orifices of a die, etc., and drawn by blowing a high-temperature, high-velocity air along the extruded resin, and the resulting fine fibers are accumulated to form webs. The melt-blown non-woven fabrics are superior to the non-woven fabrics produced by the other methods in a fiber diameter and hand. However, the melt-blown non-woven fabrics are poor in mechanical strength because their fibers are extremely fine.

To obviate the problems of poor mechanical strength, the melt-blown non-woven fabrics are conventionally laminated with non-woven fabrics produced by other methods. However, this means deteriorates the hand, gas permeability, etc. which are characteristics of the melt-blown non-woven fabrics, and increases the basis weight of the resulting non-woven fabrics.

Japanese Patent Publication No. 64-2701 discloses a non-woven fabric having improved strength and flexing resistance, which is impregnated with a binder composition comprising (A) a diene copolymer and (B) a water-soluble polyester resin in a weight ratio (A)/(B) of 95:5–50:50 on a solid basis. However, the non-woven fabric impregnated with this binder still fails to show sufficiently high strength. The effect of this binder composition on improving strength, etc. is high for non-woven fabrics made of polyesters, but low for those made of other materials.

With respect to the melt-blown non-woven fabrics, they are used for artificial leathers, etc. because of their small fiber diameters. Needle punching is conducted to increase the strength of the non-woven fabrics. However, this method only slightly succeeds in increasing the strength of the non-woven fabrics, and provides such problems as the increase of production costs and larger pores.

Japanese Patent Publication No. 60-37230 discloses a fiber structure article for artificial leathers having excellent strength and hand, which is constituted by a fiber assembly composed of three-dimensionally entangled monofilaments derived from extremely fine melt-blown fibers having an average diameter of 0.1–5.0 μm, and a padding cloth constituted by a woven fabric embedded in the fiber assembly, part of the fibers in the fiber assembly being entangled with the fibers constituting the padding cloth at an entanglement strength of at least 50 g, a basis weight ratio of the fiber assembly to the padding cloth being 1.5 or more, the entangled fibers having gaps filled with a rubbery elastic polymer, and extremely fine fibers being fluffing on the surface of the fiber structure article. However, since this fiber structure article essentially has a three-layer structure, it has an extremely large basis weight. It also has a relatively large thickness, failing to satisfy the diversified recent demands.

As a result of research, the inventors have found that the non-woven fabrics for battery separators should have:

(1) Sufficient insulating properties when inserted between both electrodes;

(2) Good capability of preventing electrode active materials particles from penetrating therethrough; and (3) Small electric resistance (high capability of permitting electrolyte ions to pass therethrough).

It has also been found that to improve the above basic properties, in addition to the fact that the non-woven fabric materials per se should have excellent insulating property, the fiber diameter should be smaller than a certain level, and the non-woven fabric itself has high strength, which enables it to have a smaller thickness.

OBJECT AND SUMMARY OF THE INVENTION

Accordingly, an object of the present invention is to provide a high-strength non-woven fabric constituted by extremely fine fibers which has increased mechanical strength without deteriorating hand, a gas permeability, etc.

Another object of the the present invention is to provide a method of producing such a high-strength non-woven fabric.

A further object of the present invention is to provide a high-strength non-woven fabric provided not only with high mechanical strength but also with good hydrophilic nature, and a method of producing such a high-strength non-woven fabric.

A still further object of the present invention is to provide a battery separator constituted by non-woven fabrics composed of fine fibers and having excellent mechanical strength and good hydrophilic nature.

As a result of intense research in view of the above objects, the inventors have found that by applying a particular nylon resin to a non-woven fabric having a particular range of an apparent fiber diameter and cross-linking the nylon resin, the resulting non-woven fabric shows extremely increased mechanical strength. The present invention is based upon this finding.

Thus, the high-strength non-woven fabric according to the present invention comprises 100 parts by weight of a non-woven fabric having an apparent fiber diameter of 0.1–15 μm; and 0.3–10 parts by weight of an N-methylol or N-alkoxymethyl nylon resin applied to the non-woven fabric, the N-methylol or N-alkoxymethyl nylon resin being cross-linked.

The method of producing a high-strength non-woven fabric according to the present invention comprises the steps of applying 0.3–10 parts by weight of an N-methylol or N-alkoxymethyl nylon resin in a solution state to 100 parts by weight of a non-woven fabric having an apparent fiber diameter of 0.1–15 μm; and drying and cross-linking the N-methylol or N-alkoxymethyl nylon resin.

The battery separator according to the present invention is constituted by a high-strength non-woven fabric comprising 100 parts by weight of a non-woven fabric having an apparent fiber diameter of 0.1–15 μm; and 0.3–10 parts by weight of an N-methylol or N-alkoxymethyl nylon resin applied to the non-woven fabric, the N-methylol or N-alkoxymethyl nylon resin being cross-linked.

BRIEF DESCRIPTION OF THE DRAWINGS

FIG. 1 (*b*) is a cross-sectional view of an orifice mounted to a tip portion of a die in FIG. 1 (*a*)

DETAILED DESCRIPTION OF THE INVENTION

Figure 1:
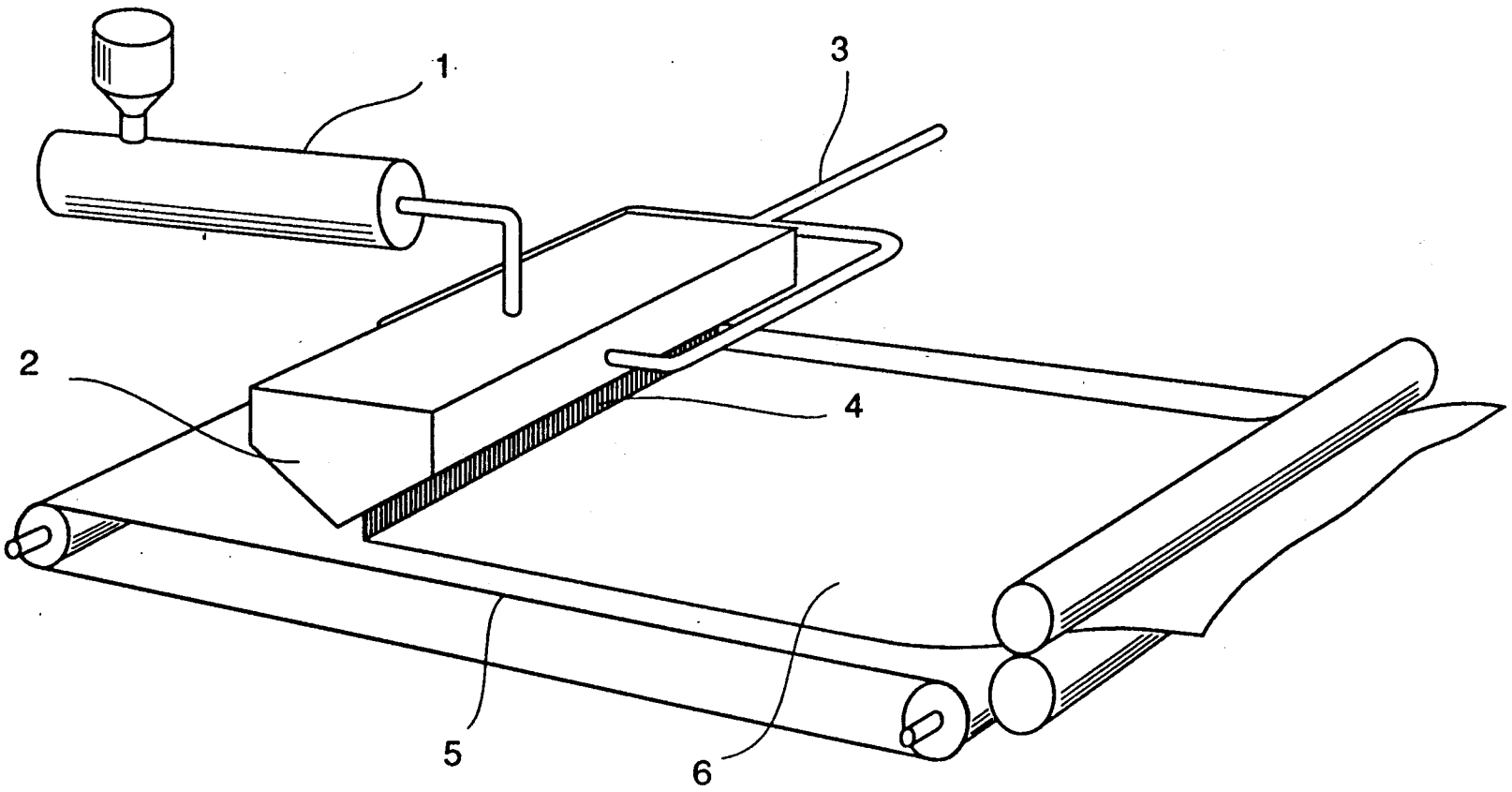
FIG. 1 (*a*) is a schematic view showing an apparatus used for a melt blowing method.
Figure 1:
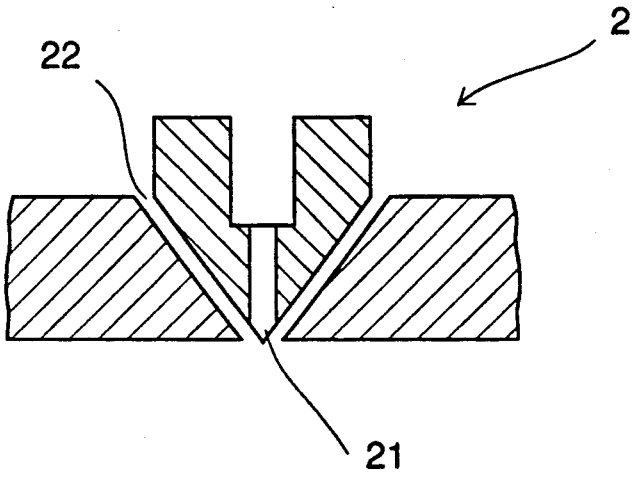

The non-woven fabrics used in the present invention are preferably those obtained by a melt blowing method. However, as long as fibers have apparent fiber diameters in the range defined above, any other non-woven fabrics produced by a dry method, a wet method, a spun bonding method, a flashing method, etc. may be used.

The melt blowing method is a method for producing a non-woven fabric by extruding a molten thermoplastic resin through a lot of orifices while blowing a hot air stream along the extruded resin to stretch the resulting fibers, thereby making the resulting monofilaments extremely finer, and blowing the monofilaments onto a metal net or a screen to accumulate them as a non-woven fabric on the net or screen.

The non-woven fabric may be made of thermoplastic resins which are not limited to particular ones. Typical examples of the thermoplastic resins include polyolefins such as polyethylene, polypropylene, etc.; polyesters such as polyethylene terephthalate, polybutylene terephthalate, etc.; polyamides such as nylon 6, nylon 66, nylon 46etc.; polyvinyl chloride, polyvinylidene chloride, polystyrene, polycarbonate, polyvinylidene fluoride, etc.; or mixtures thereof. Among them, the polyamides such as nylon 6, nylon 66, nylon 46, etc. are preferable from the view point of adhesion of an N-methylol or N-alkoxymethyl nylon resin to the non-woven fabric.

The fibers constituting the above non-woven fabric have an apparent fiber diameter of 0.1–15 μm, preferably 1–10 μm. When the apparent fiber diameter of the non-woven fabric is less than 0.1 μm, the monofilaments have too small strength, resulting in insufficient strength of the non-woven fabric. On the other hand, when the apparent fiber diameter exceeds 15 μm, the resulting non-woven fabric shows poor hand and fails to have sufficient strength.

Incidentally, since the melt-blown fiber does not have a completely circular cross section, it is generally difficult to determine the fiber diameter precisely. Accordingly, the apparent fiber diameter is utilized herein. The apparent fiber diameter can be calculated from the thickness, gas permeability, fiber gravity and basis weight of the non-woven fabric, according to the following equation:

$$D = \sqrt{94 \times \alpha^{1.5} \times (1 + 56 \times \alpha^3) \times T(\text{mm}) \times P(\text{cc/cm}^2/\text{sec})}\ ,$$

wherein D represents an apparent fiber diameter, T represents thickness, P represents a gas permeability, and $\alpha$ represents a fiber filling ratio calculated by the following equation:

$$\alpha = \frac{\text{Basis Weight (g/m}^2)}{T(\text{mm}) \times \rho \times 1000}\ ,$$

wherein $\rho$ represents a fiber density.

In the case of using for a battery separator, the non-woven fabric preferably has a thickness of 30–300 μm, particularly 50–250 μm. When the thickness is lower than 30 μm, the non-woven fabric has small mechanical strength. On the other hand, when it exceeds 300 μm, the non-woven fabric has an increased effective resistance.

With respect to the maximum pore diameter, it is preferably 55 μm or less, particularly 45 μm or less. When the maximum pore diameter exceeds 55 μm, it is difficult to prevent the diffusion of active materials and reaction products.

A high-strength battery separator can be obtained by treating the non-woven fabric having the above-mentioned apparent fiber diameter, thickness and maximum pore diameter with a N-methylol or N-alkoxymethyl nylon resin.

In the present invention, the N-methylol or N-alkoxymethyl nylon resin adhered to the non-woven fabric is a linear, high-molecular polyamide resin (nylon) having amino bonds, hydrogen atoms of whose NH groups are partially substituted with methylol groups or alkoxymethyl groups, thereby reducing the crystallinity of the nylon to lower its melting points, so that it is soluble in a solvent. The N-methylol or N-alkoxymethyl nylon resin may be a graft copolymer composed of 30–95 weight % of the above N-methylol or N-alkoxymethyl nylon resin grafted with 5–70 weight % of other monomers.

Specific examples of the above nylon resins include N-alkoxymethyl nylons such as N-methoxymethyl nylon 6 (represented by the general formula (1)), N-methoxymethyl nylon 66, N-ethoxymethyl nylon 6, N-ethoxymethyl nylon 66, etc.; N-methylol nylons such as N-methylol nylon 6, N-methylol nylon 66, etc.; and modified products of these nylons.

The percentage of these N-methylol or N-alkoxymethyl groups bonded to the NH groups in the N-methylol or N-alkoxymethyl nylon resin may vary depending upon the types of the N-methylol or N-alkoxymethyl nylon resin used, but it is preferably 5–60 weight %. When the percentage of N-methylol or N-alkoxymethyl groups is less than 5 weight %, the N-methylol or N-alkoxymethyl nylon resin shows poor solubility in a solvent. On the other hand, even if it exceeds 60 weight %, further remarkable increase in solubility cannot be obtained.

Specifically, in the case of an N-methoxymethyl nylon, the percentage of the N-methoxymethyl groups is preferably 18–40 weight %.

In the present invention, by graft-polymerizing a hydrophilic vinyl monomer to the above N-methylol or N-alkoxymethyl nylon resin, the non-woven fabric can be provided with increased strength and good hydrophilic nature.

The hydrophilic vinyl monomers which may be used in the present invention include acrylic acid, methacrylic acid, and metal salts and ammonium salts thereof; hydroxyethyl acrylate, hydroxyethyl methacrylate, polyethylene glycol monomethacrylate, itaconic acid, acrylamide, N-methylol acrylamide, and their mixtures, etc.

The modified N-methylol or N-alkoxymethyl nylon resin containing a hydrophilic vinyl monomer graft-polymerized to the N-methylol or N-alkoxymethyl nylon resin may be, for instance, an N-methoxymethyl nylon modified product shown by the general formula (2):

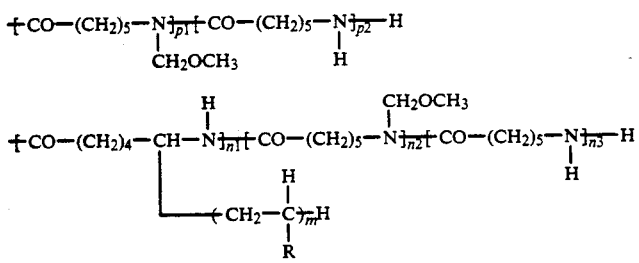

(1)

(2)

wherein p1, p2, n1, n2, n3 and m are positive integers, R represents a water-soluble polar group such as a carboxylate group (—COOM), an acid amide group (—$CONH_2$), a hydroxyl group (—OH), etc. In the preferred embodiment, p1 is 1–10, p2 is 1–100, n1 is 1–100, n2 is 1–10, n3 is 1–10 and m is 1–10. M in the carboxylate group may be Na, K, Ca, Mg, Al, Ba, Mo, W, Co, V, etc.

The percentage of the hydrophilic vinyl monomer in the modified N-methylol or N-alkoxymethyl nylon resin is preferably 5–70 weight %, particularly 10–40 weight %.

When the percentage of the hydrophilic vinyl monomer is less than 5 weight %, a sufficient effect of improving the hydrophilic nature of the non-woven fabric cannot be obtained. On the other hand, when it exceeds 70 weight %, sufficient increase of strength cannot be obtained.

The production of the high-strength non-woven fabric according to the present invention will be explained below.

First, the non-woven fabric is produced from a thermoplastic resin. As mentioned above, the non-woven fabric is preferably produced by a melt blowing method.

A typical example of an apparatus for carrying out the melt blowing method is shown in FIG. 1 (*a*). The structure of a die 2 of the apparatus shown in FIG. 1 (*a*) is shown in detail in FIG. 1 (*b*). The thermoplastic resin is melted in an extruder 1 and extruded through a lot of small orifices 21 arranged in a line in the die 2. At the same time, a high-velocity gas such as a heated air supplied through a heated gas conveying pipe 3 is ejected through slits 22 located on both sides of the orifices 21 along the extruded molten thermoplastic resin to form them into extremely fine fibers 4. The resulting fibers (monofilaments) 4 are accumulated on a moving screen 5 as a web 6.

In the melt blowing method, a non-woven fabric having a desired apparent fiber diameter can be produced by adjusting a die temperature, temperature and pressure of the heated gas, the amount of a resin extruded, etc., depending upon of the types of the thermoplastic resin used.

The non-woven fabric thus obtained is coated with the N-methylol or N-alkoxymethyl nylon resin. The amount of the N-methylol or N-alkoxymethyl nylon resin applied to the non-woven fabric is 0.3–10 parts by weight, preferably 0.5–5 parts by weight per 100 parts by weight of the non-woven fabric. When the amount of the N-methylol or N-alkoxymethyl nylon resin is less than 0.3 parts by weight, sufficient effect of improving the mechanical strength, etc. cannot be obtained. On the other hand, even though it exceeds 10 parts by weight, further effect of improving mechanical strength cannot obtained, and the hand, gas permeability, etc. of the resulting high-strength non-woven fabric are deteriorated.

The application of the N-methylol or N-alkoxymethyl nylon resin to the non-woven fabric can be conducted by an immersion method in which the non-woven fabric is immersed in a solution of the N-methylol or N-alkoxymethyl nylon resin, a spray method in which a solution of the N-methylol or N-alkoxymethyl nylon resin is sprayed onto the non-woven fabric, etc. For instance, in the case of the immersion method, the non-woven fabric is immersed in an immersion bath containing the solution of the N-methylol or N-alkoxymethyl nylon resin to impregnate the non-woven fabric with the N-methylol or N-alkoxymethyl nylon resin, and then squeezing an excess N-methylol or N-alkoxymethyl nylon resin solution from the non-woven fabric. Incidentally, by using an apparatus (padder) in which an immersion bath and a squeezing apparatus are integrally provided, the application of the N-methylol or N-alkoxymethyl nylon resin can be carried out efficiently.

Solvents for the N-methylol or N-alkoxymethyl nylon resin solution are generally lower alcohols such as methanol, ethanol, etc. However, in the case of using the N-methylol or N-alkoxymethyl nylon resin modified with a hydrophilic vinyl monomer, aqueous media such as water, water+alcohol, etc. may be used.

After applying a predetermined amount of the N-methylol or N-alkoxymethyl nylon resin, it is dried and cross-linked. Drying and cross-linking can be carried out by heating. To cross-link the N-methylol or N-alkoxymethyl nylon resin, the heating temperature is generally 70°-200° C., preferably 90°-180° C. The drying time may be determined depending upon a drying temperature, types of solvents, the amount of an N-methylol or N-alkoxymethyl nylon resin used, etc.

The drying and cross-linking of the N-methylol or N-alkoxymethyl nylon resin applied to the non-woven fabric can be efficiently carried out by a two-step heating. In the first heating step, for instance, a relatively low temperature such as 135° C. or lower is utilized to remove an excess solvent and to conduct drying and partial cross-linking. In a subsequent heating step, a relatively high temperature such as 135°-200° C. is used to sufficiently conduct cross-linking.

The non-woven fabric thus obtained according to the present invention has an extremely small apparent fiber diameter and improved mechanical strength, without deteriorating the inherent hand and gas permeability of the non-woven fabric.

In the present invention, in addition to the treatment of the non-woven fabric with the N-methylol or N-alkoxymethyl nylon resin, the non-woven fabric may be treated with such additives as a cross-linking agent, a surfactant, an antistatic agent, a frame retardant, etc. In this case, as in the case of applying the N-methylol or N-alkoxymethyl nylon resin, a method of immersing the non-woven fabric in an additive solution, or a method of spraying such an additive solution to the non-woven fabric, etc. may be employed.

The high-strength non-woven fabric of the present invention may be subsequently subjected to various treatments such as raising, pressing, etc., if necessary.

In the present invention, by applying the N-methylol or N-alkoxymethyl nylon resin to the non-woven fabric having an apparent fiber diameter of 0.1-15 μm and cross-linking the N-methylol or N-alkoxymethyl nylon resin, the resulting non-woven fabric has extremely high mechanical strength. The reason therefor is not necessarily clear, but it may be considered that the N-methylol or N-alkoxymethyl nylon resin adhered to the fine fibers of the non-woven fabric is cross-linked at entanglement points of fibers, thereby increasing the bonding strength between the fibers. To achieve such increase in bonding strength, the non-woven fabric should have a larger contact surface area between their fibers. For this purpose, the apparent fiber diameter should be in the range as mentioned above.

Also, such a non-woven fabric shows a sufficiently low electric resistance when used as a battery separator.

The present invention will be explained in further detail by way of the following Examples. Incidentally, in each Example and Comparative Example, the properties of the non-woven fabric were measured by the following methods.

(1) Basis weight

A test piece of 10 cm×10 cm was cut out from the non-woven fabric, and after achieving a moisture equilibrium (20° C., 65 RH), its weight was measured. Unit is g/m$^2$.

(2) Thickness (i) In the case of pressing with a hot-pressing roll machine

Five presser feet of 10 mm in diameter were placed under a load of 140 g on a one-meter-wide non-woven fabric at an equal interval (10 cm interval), and after the lapse of sufficient time for the height of the presser feet to become stable, the thickness of the non-woven fabric was measured.

(ii) In the case of no pressing

Five presser feet of 25 mm in diameter under a load of 35 g were placed on a one-meter-wide non-woven fabric at an equal interval (10 cm interval), and after the lapse of sufficient time for the height of the presser feet to become stable, the thickness of the non-woven fabric was measured.

(3) Gas permeability

Measured according to JIS L 1096 (general method of testing woven fabrics).

(4) Tensile strength

Measured on a test piece of 5 cm×20 cm cut out from a non-woven fabric according to JIS L 1096 (general method of testing woven fabrics), by using a tensile test apparatus having a constant expanding velocity, at a grip distance of 10 cm and a tensile speed of 20±2 cm/minute both in a machine direction (MD) and in a transverse direction (TD).

(5) Liquid retention ratio

Figure 2:
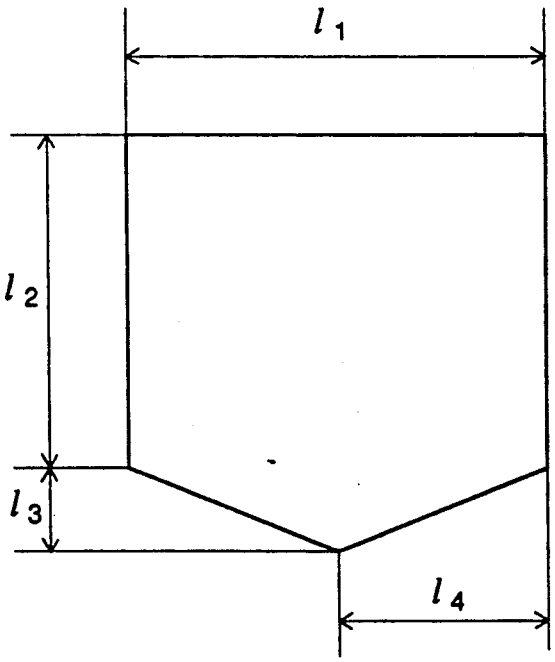
FIG. 2 is a schematic view showing a test piece used for the measurement of a liquid retention ratio.

A test piece shown in FIG. 2 ($l_1$=150 mm, $l_2$=120 mm, $l_3$=30 mm, $l_4$=75 mm) was cut out from a non-woven fabric, and after achieving a moisture equilibrium (20° C., 65 RH), the weight $W_0$ of the test piece was measured to an order to 1 mg. Next, this test piece was immersed in a potassium hydroxide solution (KOH concentration=30 weight %) having a specific gravity of 1.30, taken out of the solution, and after 10 minutes measured with respect to its weight W. The liquid retention ratio was calculated by the following equation:

$$\text{Liquid Retention Ratio (\%)} = \frac{(W - W_0)}{W_0}.$$

(6) Liquid absorption rate

A test piece of 25 mm (MD)×250 mm (TD) was cut out from a non-woven fabric, and fastened to a horizontal rod placed above a water bath such that each test piece was suspended vertically. The water bath contained a potassium hydroxide solution (KOH concentration=30 weight %) having a specific gravity of 1.30 kept at 20°±2° C. The horizontal rod was lowered while keeping the lower end of each test piece on a horizontal line, so that 50 mm of a lower end portion of each test piece was immersed in the solution. The solution was absorbed upward by a capillary phenomenon, and after 30 minutes, the height of the solution in the test piece was measured.

(7) Apparent fiber diameter

The apparent fiber diameter of the non-woven fabric was calculated by the following equation:

$$D = \sqrt{94 \times \alpha^{1.5} \times (1 + 56 \times \alpha^3) \times T(\text{mm}) \times P(\text{cc/cm}^2/\text{sec})},$$

wherein D represents an apparent fiber diameter, T represents thickness, P represents a gas permeability, and α represents a fiber filling ratio calculated by the following equation:

$$\alpha = \frac{\text{Basis Weight (g/m}^2)}{T(\text{mm}) \times \rho \times 1000},$$

wherein $\rho$ represents a fiber density. The gas permeability and the basis weight are those obtained by the measurements (1) and (3).

(8) Maximum pore diameter

Measured according to ASTM F316 by using ethanol as a solvent.

(9) Electric resistance

A test piece of 7 cm×7 cm was cut out from a non-woven fabric, and measured with respect to electric resistance according to JIS C2313 (Separators for Lead-Acid Batteries), §5.2.4 (Method of Measuring Electric Resistance), using the following equation:

$$R_0=(R'-R)/5n$$

wherein $R_0$: Resistance of a separator ($\Omega\cdot 100\ cm^2$/each sheet),

R': Resistance ($\Omega$) when there are test pieces,

R: Resistance ($\Omega$) when there are no test pieces, and n: The number of test pieces inserted between electrodes.

An electrolytic solution was a KOH solution (concentration: 30 weight %) having a specific gravity of 1.30 at 20° C.

EXAMPLE 1 AND COMPARATIVE EXAMPLES 1, 2

A nylon fiber non-woven fabric having an apparent fiber diameter of 6.2 μm and a basis weight of about 70 g/m² was produced by a melt blowing method. 100 parts by weight of this non-woven fabric was impregnated with 3 parts by weight of a modified N-methoxymethyl nylon (graft copolymer of 70 parts by weight of a 30% N-methoxymethylated nylon 6 and 30 parts by weight of a hydrophilic vinyl monomer (acrylamide)) in a solution state by using a padder (apparatus comprising an immersion bath and a squeezing device), and then dried at a temperature of 110°-135° C. for 2 minutes. This non-woven fabric was subjected to a heat treatment at 135°-150° C.

Next, to prevent fluffing and to improve its handling, the non-woven fabric was pressed at a temperature of 110° C. by using a hot press roll machine. The melt-blown non-woven fabric thus obtained was measured with respect to a basis weight, a thickness, a gas permeability, a tensile strength, a tensile elongation, a retention ratio of a potassium hydroxide solution and an absorption rate of a potassium hydroxide solution. The results are shown in Table 1 together with an apparent fiber diameter and the amount of the modified N-methoxymethyl nylon resin applied to the non-woven fabric.

For comparison, Example 1 was repeated except for treating the non-woven fabric with a 0.8%-surfactant (sodium dodecylbenzene sulfonate) solution instead of the modified N-methoxymethyl nylon (Comparative Example 1). Also, Example 1 was repeated except for omitting the treatment with the modified N-methoxymethyl nylon (Comparative Example 2). The same measurement of properties as above was carried out on each of the products in Comparative Examples 1 and 2. The results are shown also in Table 1.

Next, with respect to each test piece, a maximum pore diameter and an electric resistance were measured. The results are shown in Table 2.

EXAMPLES 2-4 AND COMPARATIVE EXAMPLE 3

Nylon fiber non-woven fabrics having an apparent fiber diameter of 6.2 μm and a basis weight of about 50 g/m² were produced by a melt blowing method. Each non-woven fabric was impregnated with a modified N-methoxymethyl nylon (graft copolymer of 70 parts by weight of a 30% N-methoxymethylated nylon 6 and 30 parts by weight of a hydrophilic vinyl monomer (acrylamide)) in a solution state by using a padder in an amount of 1, 3 and 6 parts by weight, respectively, per 100 parts by weight of the non-woven fabric, and then dried at a temperature of 110°-135° C. for 2 minutes. Each of the resulting non-woven fabrics was subjected to a heat treatment at 135°-150° C.

Next, to prevent fluffing and to improve its handling, each non-woven fabric was pressed at a temperature of 110° C. by using a hot press roll machine. Each melt-blown non-woven fabric thus obtained was measured with respect to a basis weight, a thickness, a gas permeability, a tensile strength, a tensile elongation, a retention ratio of a potassium hydroxide solution and an absorption rate of a potassium hydroxide solution. The results are shown in Table 1 together with an apparent fiber diameter and the amount of the modified N-methoxymethyl nylon resin applied to the non-woven fabric.

For comparison, the above non-woven fabric not treated with the modified N-methoxymethyl nylon was subjected to the same measurement of properties as above (Comparative Example 3). The results also are shown in Table 1.

TABLE 1

| | Example No. | | | | Comparative Example No. | | |
|---|---|---|---|---|---|---|---|
| | 1 | 2 | 3 | 4 | 1 | 2 | 3 |
| Apparent Fiber Diameter (μm) | 6.2 | 6.2 | 6.2 | 6.2 | 6.2 | 6.2 | 6.2 |
| Amount of Nylon Resin Applied* | 3 | 1 | 3 | 6 | 0.8** | — | — |
| Basis Weight (g/m²) | 75 | 55 | 56 | 57 | 74 | 73 | 54 |
| Thickness (mm) | 0.20 | 0.14 | 0.17 | 0.15 | 0.21 | 0.21 | 0.16 |
| Gas Permeability (cc/cm²/sec) | 2.9 | 7.7 | 5.9 | 4.6 | 3.9 | 5.5 | 7.9 |
| Tensile Strength/ Tensile Elongation (MD) [(kg/50 mm)/%] | 9.6/54 | 5.4/31 | 7.2/56 | 8.8/61 | 4.7/13 | 3.5/8 | 3.2/12 |
| Tensile Strength/ Tensile Elongation (TD) [(kg/50 mm)/%] | 4.9/101 | 3.3/87 | 3.3/96 | 3.9/111 | 3.3/51 | 3.6/63 | 2.6/60 |
| Retention Ratio of 30% KOH Solution (%) | 219 | 295 | 236 | 209 | 272 | 56 | 77 |
| Absorption Rate of 30%-KOH Solution (MD/TD) | 43/33 | 30/17 | 70/46 | 18/18 | 73/62 | 0/0 | 0/5 |

TABLE 1-continued

| | Example No. | | | | Comparative Example No. | | |
|---|---|---|---|---|---|---|---|
| | 1 | 2 | 3 | 4 | 1 | 2 | 3 |
| (mm/30 minutes) | | | | | | | |

Note
*Parts by weight.
**Treated with a 0.8%-surfactant solution.

TABLE 2

| | Example No. | Comparative Example No. | |
|---|---|---|---|
| | 1 | 1 | 2 |
| Maximum Pore Diameter (μm) | 29.4 | 27.5 | 28.8 |
| Electric Resistance ($\times 10^{-3}\ \Omega \cdot 100\ cm^2$ per each sheet) | 0.75 | — | — |

As is clear from Table 1, the non-woven fabric of Example 1 shows a tensile strength about 3 times as high as that of the untreated non-woven fabric in Comparative Example 2, and also shows an improved retention ratio of an alkali solution. Also, the non-woven fabric of Example 1 shows a tensile strength in an MD direction about 2 times as high as that of the non-woven fabric surface-treated with a surfactant in Comparative Example 1.

The non-woven fabric of Example 2 which has 1 weight % of an modified N-methoxymethyl nylon shows dramatically improved tensile strength and retention ratio and absorption rate of an alkali solution as compared with the non-woven fabric of Comparative Example 3 subjected to no treatment with the modified N-methoxymethyl nylon. Among the non-woven fabric of Examples 2–4, a tendency is appreciated that their tensile strength increases as the amount of the modified N-methoxymethyl nylon increases.

With respect to the hand, there is no difference before and after the treatment in each Example.

EXAMPLES 5–7 AND COMPARATIVE EXAMPLE 4

Nylon fiber non-woven fabrics having an apparent fiber diameter of 6.9–10.3 μm and a basis weight of about 50–70 g/m$^2$ were produced by a melt blowing method. 100 parts by weight of each non-woven fabric was impregnated with 1 part by weight of a modified N-methoxymethyl nylon (graft copolymer of 70 parts by weight of a 30% N-methoxymethylated nylon 6 and 30 parts by weight of a hydrophilic vinyl monomer (ammonium acrylate)) in a solution state by using a padder, and then dried at a temperature of 110°–135° C. for 2 minutes. Each of the resulting non-woven fabrics was subjected to a heat treatment at 135°–150° C.

Next, to prevent fluffing and to improve its handling, each non-woven fabric was pressed at a temperature of 110° C. by using a hot press roll machine. Each melt-blown non-woven fabric thus obtained was measured with respect to a basis weight, a thickness, a maximum pore diameter, a tensile strength and a tensile elongation before and after the treatment with the modified N-methoxymethyl nylon, and the increase in a tensile strength by the treatment. The results are shown in Table 3 together with an apparent fiber diameter and the amount of the modified N-methoxymethyl nylon resin applied to the non-woven fabric.

For comparison, a melt-blown non-woven nylon fabric having an apparent fiber diameter of 15.5 μm was treated with the above N-methoxymethyl nylon in the same manner as above (Comparative Example 4), and the same measurement was conducted. The results are also shown in Table 3.

EXAMPLES 8–10 AND COMPARATIVE EXAMPLE 5

Nylon fiber non-woven fabrics having an apparent fiber diameter of 6.5–6.8 μm and a basis weight of 60–80 g/m$^2$ were produced by a melt blowing method. 100 parts by weight of each non-woven fabric was impregnated with 1 part by weight of a 30% N-methoxymethylated nylon in a solution state by using a padder, and then dried at a temperature of 110°–135° C. for 2 minutes. Each of the resulting non-woven fabrics was subjected to a heat treatment at 135°–150° C.

Next, to prevent fluffing and to improve its handling, each non-woven fabric was pressed at a temperature of 110° C. by using a hot press roll machine. Each melt-blown non-woven fabric thus obtained was measured with respect to a basis weight, a thickness, a maximum pore diameter, a tensile strength and a tensile elongation before and after the treatment with the N-methoxymethyl nylon, and the increase in a tensile strength by the treatment. The results are shown in Table 3 together with an apparent fiber diameter and the amount of the N-methoxymethyl nylon resin applied to the non-woven fabric.

For comparison, a melt-blown non-woven nylon fabric having an apparent fiber diameter of 15.2 μm was treated with the above 30% N-methoxymethylated nylon in the same manner as above (Comparative Example 5), and the same measurement was conducted. The results are also shown in Table 3.

TABLE 3

| | Example No. | | | | | | Comparative Example No. | |
|---|---|---|---|---|---|---|---|---|
| | 5 | 6 | 7 | 8 | 9 | 10 | 4 | 5 |
| Apparent Fiber Diameter (μm) | 10.3 | 6.9 | 7.1 | 6.5 | 6.8 | 6.5 | 15.5 | 15.2 |
| Amount of Nylon Resin Applied* | 1(1) | 1(1) | 1(1) | 1(2) | 1(2) | 1(2) | 1(1) | 1(2) |
| Basis Weight (g/m$^2$) | 74 | 73 | 50 | 62 | 67 | 88 | 66 | 71 |
| Thickness (mm) | 0.20 | 0.21 | 0.20 | 0.20 | 0.20 | 0.19 | 0.22 | 0.20 |
| Maximum Pore Diameter (μm) | 39.9 | 29.9 | 34.6 | 29.9 | 29.4 | 25.3 | 75.4 | 69.4 |

TABLE 3-continued

| | Example No. | | | | | | Comparative Example No. | |
|---|---|---|---|---|---|---|---|---|
| | 5 | 6 | 7 | 8 | 9 | 10 | 4 | 5 |
| Tensile Strength/ Tensile Elongation (MD) After Treatment [(kg/50 mm)/%] | 8.6/37 | 7.2/56 | 8.8/61 | 7.7/28 | 7.3/27 | 7.5/37 | 5.4/31 | 6.0/43 |
| Tensile Strength/ Tensile Elongation (MD) Before Treatment [(kg/50 mm)/%] | 5.9/29 | 2.1/15 | 2.0/18 | 3.3/13 | 3.7/9 | 4.4/16 | 4.2/3.4 | 4.7/25 |
| Increase in Tensile Strength (MD) (%) | 46 | 243 | 340 | 133 | 97 | 70 | 29 | 28 |

Note
*Parts by weight.
(1)Modified N-methoxymethyl nylon.
(2)N-methoxymethyl nylon.

As is clear from Table 3, the non-woven fabrics of Examples 5-10 have drastically increased tensile strength by the treatment with the modified N-methoxymethyl nylon or the N-methoxymethyl nylon. Among the non-woven fabrics of Examples 5-10, the increase in tensile strength is smallest in Example 5 in which the apparent fiber diameter was 10.3 μm. On the other hand, in the cases of the non-woven fabrics of Comparative Examples 4 and 5 in which the apparent fiber diameter exceeded 15 μm, only little increase in a tensile strength was obtained even by the treatment with the modified N-methoxymethyl nylon or the N-methoxymethyl nylon. This means that the increase in strength can be obtained only when the apparent fiber diameter of the non-woven fabric is 0.1-15 μm.

EXAMPLES 11-13 AND COMPARATIVE EXAMPLES 6-8

Nylon fiber non-woven fabrics having an apparent fiber diameter of 6.3-6.5 μm and a basis weight of about 50-70 g/m$^2$ were produced by a melt blowing method. 100 parts by weight of each non-woven fabric was impregnated with 1 part by weight of a modified N-methoxymethyl nylon (graft copolymer of 70 parts by weight of a 30% N-methoxymethylated nylon 6 and 30 parts by weight of a hydrophilic vinyl monomer (ammonium acrylate)) in a solution state by using a padder, and then dried at a temperature of 110°-135° C. for 2 minutes. Each of the resulting non-woven fabrics was subjected to a heat treatment at 135°-150° C.

Each melt-blown non-woven fabric thus obtained was measured with respect to a basis weight, a thickness, a gas permeability, a tensile strength, a tensile elongation, a retention ratio of a potassium hydroxide solution and an absorption rate of a potassium hydroxide solution. The results are shown in Table 4 together with an apparent fiber diameter and the amount of the modified N-methoxymethyl nylon resin applied to the non-woven fabric.

For comparison, Examples 11-13 were repeated except for conducting no treatment with the modified N-methoxymethyl nylon (Comparative Examples 6-8). The same measurement of properties as above was carried out on each of the products in Comparative Examples 6-8. The results are also shown in Table 4.

EXAMPLE 14 AND COMPARATIVE EXAMPLE 9

A polypropylene fiber non-woven fabric having an apparent fiber diameter of 8.2 μm and a basis weight of about 50 g/m$^2$ was produced by a melt blowing method. 100 parts by weight of this non-woven fabric was impregnated with 2.9 parts by weight of a modified N-methoxymethyl nylon (graft copolymer of 70 parts by weight of a 30% N-methoxymethylated nylon 6 and 30 parts by weight of a hydrophilic vinyl monomer (ammonium acrylate)) in a solution state by using a padder, and then dried at a temperature of 110°-135° C. for 2 minutes. The resulting non-woven fabric was subjected to a heat treatment at 135°-150° C.

The melt-blown non-woven fabric thus obtained was measured with respect to a basis weight, a thickness, a gas permeability, a tensile strength, a tensile elongation, a retention ratio of a potassium hydroxide solution and an absorption rate of a potassium hydroxide solution. The results are shown in Table 4 together with an apparent fiber diameter and the amount of the modified N-methoxymethyl nylon resin applied to the non-woven fabric.

For comparison, Examples 14 was repeated except for conducting no treatment with the modified N-methoxymethyl nylon (Comparative Example 9). The same measurement of properties as above was carried out on the product in Comparative Example 9. The results are shown in Table 4.

EXAMPLE 15 AND COMPARATIVE EXAMPLE 10

A polyethylene terephthalate fiber non-woven fabric having an apparent fiber diameter of 7.0 μm and a basis weight of about 50 g/m$^2$ was produced by a melt blowing method. 100 parts by weight of this non-woven fabric was impregnated with 3.6 parts by weight of a modified N-methoxymethyl nylon (graft copolymer of 70 parts by weight of a 30% N-methoxymethylated nylon 6 and 30 parts by weight of a hydrophilic vinyl monomer (ammonium acrylate)) in a solution state by using a padder, and then dried at a temperature of 110°-135° C. for 2 minutes. The resulting non-woven fabric was subjected to a heat treatment at 135°-150° C.

The melt-blown non-woven fabric thus obtained was measured with respect to a basis weight, a thickness, a gas permeability, a tensile strength, a tensile elongation, a retention ratio of a potassium hydroxide solution and an absorption rate of a potassium hydroxide solution. The results are shown in Table 4 together with an apparent fiber diameter and the amount of the modified N-methoxymethyl nylon resin applied to the non-woven fabric.

For comparison, Examples 15 was repeated except for conducting no treatment with the modified N-methoxymethyl nylon (Comparative Example 10). The same measurement of properties as above was carried out on the product in Comparative Example 10. The results are also shown in Table 4.

COMPARATIVE EXAMPLES 11–13

Nylon fiber non-woven fabrics having an apparent fiber diameter of 17.9 μm and a basis weight of about 70 g/m$^2$ were produced by a spun bonding method. 100 parts by weight of each non-woven fabric was impregnated with a modified N-methoxymethyl nylon (graft copolymer of 70 parts by weight of a 30% N-methoxymethylated nylon 6 and 30 parts by weight of a hydrophilic vinyl monomer (ammonium acrylate)) in an amount of 2.9 and 9.7 parts by weight, respectively, by using a padder, and then dried at a temperature of 110°–135° C. for 2 minutes (Comparative Examples 11 and 12). Each of the resulting non-woven fabrics was subjected to a heat treatment at 135°–150° C.

Each melt-blown non-woven fabric thus obtained was measured with respect to a basis weight, a thickness, a gas permeability, a tensile strength, a tensile elongation, a retention ratio of a potassium hydroxide solution and an absorption rate of a potassium hydroxide solution. The results are shown in Table 4 together with an apparent fiber diameter and the amount of the modified N-methoxymethyl nylon resin applied to the non-woven fabric.

Further, the above non-woven fabric not treated with the modified N-methoxymethyl nylon (Comparative Example 13) was subjected to the same measurement of properties as above. The results are shown in Table 4.

COMPARATIVE EXAMPLES 14, 15

A nylon fiber non-woven fabric having an apparent fiber diameter of 16.9 μm and a basis weight of about 60 g/m$^2$ was produced by a spun bonding method. 100 parts by weight of this non-woven fabric was impregnated with 2.9 parts by weight of a modified N-methoxymethyl nylon (graft copolymer of 70 parts by weight of a 30% N-methoxymethylated nylon 6 and 30 parts by weight of a hydrophilic vinyl monomer (ammonium acrylate)) in a solution state by using a padder, and then dried at a temperature of 110°–135° C. for 2 minutes. The resulting non-woven fabric was subjected to a heat treatment at 135°–150° C.

The melt-blown non-woven fabric thus obtained (Comparative Example 14) was measured with respect to a basis weight, a thickness, a gas permeability, a tensile strength, a tensile elongation, a retention ratio of a potassium hydroxide solution and an absorption rate of a potassium hydroxide solution. The results are shown in Table 4 together with an apparent fiber diameter and the amount of the modified N-methoxymethyl nylon resin applied to the non-woven fabric.

Further, the above non-woven fabric not treated with the modified N-methoxymethyl nylon (Comparative Example 15) was subjected to the same measurement of properties as above. The results are shown in Table 4.

TABLE 4

| | Example No. | | | | | Comparative Example No. | | |
|---|---|---|---|---|---|---|---|---|
| | 11 | 12 | 13 | 14 | 15 | 6 | 7 | 8 |
| Apparent Fiber Diameter (μm) | 6.3 | 6.3 | 6.5 | 8.2(1) | 7.0(2) | 6.3 | 6.3 | 6.5 |
| Amount of Nylon Resin Applied* | 1 | 1 | 1 | 2.9 | 3.6 | — | — | — |
| Basis Weight (g/m$^2$) | 53 | 58 | 65 | 51 | 54 | 55 | 61 | 67 |
| Thickness (mm) | 0.25 | 0.31 | 0.33 | 0.39 | 0.32 | 0.43 | 0.49 | 0.52 |
| Gas Permeability (cc/cm$^2$/sec) | — | — | — | 35.1 | 28.0 | — | — | — |
| Tensile Strength/ Tensile Elongation (MD) [(kg/50 mm)/%] | 5.6/19 | 5.6/13 | 6.0/12 | 5.3/35 | 4.9/24 | 3.3/13 | 3.3/11 | 3.9/14 |
| Tensile Strength/ Tensile Elongation (TD) [(kg/50 mm)/%] | 3.3/79 | 4.1/74 | 4.4/74 | 2.4/56 | 2.5/53 | 3.5/82 | 3.7/90 | 4.0/95 |
| Retention Ratio of 30% KOH Solution (%) | 375 | 568 | 444 | 284 | 404 | 119 | 109 | 95 |
| Absorption Rate of 30% KOH Solution (MD/TD) (mm/30 minutes) | 225/187 | 229/24 | 227/202 | 14/8 | 199/175 | 6/8 | 8/8 | 6/6 |

| | Comparative Example No. | | | | | | |
|---|---|---|---|---|---|---|---|
| | 9 | 10 | 11 | 12 | 13 | 14 | 15 |
| Apparent Fiber Diameter (μm) | 8.2(1) | 7.0(2) | 17.9(3) | 17.9(3) | 17.9(3) | 16.9(3) | 16.9(3) |
| Amount of Nylon Resin Applied* | — | — | 2.9 | 9.7 | — | 2.9 | — |
| Basis Weight (g/m$^2$) | 50 | 51 | 75 | 85 | 71 | 64 | 58 |
| Thickness (mm) | 0.43 | 0.38 | 0.36 | 0.38 | 0.40 | 0.27 | 0.30 |
| Gas Permeability (cc/cm$^2$/sec) | 31.6 | 36.0 | 75.5 | 66.1 | 68.4 | 80.6 | 83.0 |
| Tensile Strength/ Tensile Elongation (MD) [(kg/50 mm)/%] | 4.1/43 | 3.8/22 | 30.7/32 | 34.3/34 | 33.6/37 | 37.6/36 | 31.3/35 |
| Tensile Strength/ Tensile Elongation (TD) [(kg/50 mm)/%] | 2.5/83 | 2.4/62 | 15.7/28 | 16.5/30 | 14.8/35 | 12.8/31 | 11.0/31 |
| Retention Ratio of 30% KOH Solution (%) | 0 | 30 | 275 | 260 | 297 | 230 | 232 |
| Absorption Rate of 30% KOH Solution (MD/TD) | 0/0 | 11/11 | 153/132 | 127/121 | 13/10 | 167/105 | 35/21 |

TABLE 4-continued (mm/30 minutes)

Note
*Parts by weight.
(1)Polypropylene resin fibers were used.
(2)Polyethylene terephthalate resin fibers were used.
(3)Spun-bonded nylon non-woven fabric was used.

As is clear from Table 4, the non-woven fabrics of Examples 11–13 show dramatically improved tensile strength and retention ratio and absorption rate of an alkali solution as compared with the non-woven fabrics of Comparative Examples 6–8 subjected to no treatment with the modified N-methoxymethyl nylon.

Also, the non-woven fabrics of Examples 14 and 15 show improved tensile strength as compared with those of Comparative Examples 9 and 10 subjected to no treatment with the modified N-methoxymethyl nylon, and show drastically improved retention ratio and absorption rate of an alkali solution.

The non-woven fabrics of Comparative Examples 11–15 show substantially no increase in a tensile strength regardless of whether or not the treatment with the modified N-methoxymethyl nylon was carried out. This is because the non-woven fabrics produced by a spun bonding method have relatively large apparent fiber diameters, failing to provide non-woven fabric composed of fine fibers.

Incidentally, with respect to the hand, there is no difference before and after the treatment in Examples 11–15.

EXAMPLES 16–18

Nylon fiber non-woven fabrics having an apparent fiber diameter of 6.5 μm and a basis weight of about 60–80 g/m$^2$ were produced by a melt blowing method. 100 parts by weight of each non-woven fabric was impregnated with 1 part by weight of a modified N-methoxymethyl nylon (graft copolymer of 70 parts by weight of a 30% N-methoxymethylated nylon 6 and 30 parts by weight of a hydrophilic vinyl monomer (ammonium acrylate)) in a solution state by using a padder, and then dried at a temperature of 110°–135° C. for 2 minutes. Each of the resulting non-woven fabrics was subjected to a heat treatment at 135°–150° C.

Next, to prevent fluffing and to improve its handling, each non-woven fabric was pressed at a temperature of 110° C. by using a hot press roll machine. Each melt-blown non-woven fabric thus obtained was measured with respect to a basis weight, a thickness, a maximum pore diameter, a tensile strength, a tensile elongation, a retention ratio of a potassium hydroxide solution and an electric resistance. The results are shown in Table 5 together with an apparent fiber diameter and the amount of the modified N-methoxymethyl nylon resin applied to the non-woven fabric.

COMPARATIVE EXAMPLE 16

A nylon fiber non-woven fabric having an apparent fiber diameter of 18.0 μm and a basis weight of about 80 g/m$^2$ was produced by a spun bonding method. 100 parts by weight of this non-woven fabric was impregnated with a 0.8%-surfactant (sodium dodecylbenzene sulfonate) solution by using a padder, and then dried at a temperature of 110°–135° C. for 2 minutes. The resulting non-woven fabric was subjected to a heat treatment at 135°–150° C.

The spun-bonded non-woven fabric thus obtained was subjected to the same measurement as in Example 16. The results are shown in Table 5.

COMPARATIVE EXAMPLE 17

A nylon fiber non-woven fabric having an apparent fiber diameter of 6.5 μm and a basis weight of about 70 g/m$^2$ was produced by a melt blowing method. Without applying a modified N-methoxymethyl nylon (graft copolymer of 70 parts by weight of a 30% N-methoxymethylated nylon 6 and 30 parts by weight of a hydrophilic vinyl monomer (ammonium acrylate)), the resulting non-woven fabric was subjected to a heat treatment at 135°–150° C., and subjected to the same measurement as in Example 16. The results are shown in Table 5.

COMPARATIVE EXAMPLE 18

A nylon fiber non-woven fabric having an apparent fiber diameter of 18.4 μm and a basis weight of about 70 g/m$^2$ was produced by a spun bonding method. 100 parts by weight of this non-woven fabric was impregnated with a 0.8%-surfactant (sodium dodecylbenzene sulfonate) solution by using a padder, and then dried at a temperature of 110°–135° C. for 2 minutes. The resulting non-woven fabric was subjected to a heat treatment at 135°–150° C.

The spun-bonded non-woven fabric thus obtained was subjected to the same measurement as in Example 16. The results are shown in Table 5.

TABLE 5

| | Example No. | | | Comparative Example No. | | |
|---|---|---|---|---|---|---|
| | 16 | 17 | 18 | 16 | 17 | 18 |
| Apparent Fiber Diameter (μm) | 6.5 | 6.5 | 6.5 | 18.0(2) | 6.5 | 18.4(2) |
| Amount of Nylon Resin Applied* | 1 | 1 | 1 | 0.8(1) | — | 0.8(1) |
| Basis Weight (g/m$^2$) | 61 | 70 | 79 | 87 | 70 | 70 |
| Thickness (mm) | 0.20 | 0.21 | 0.21 | 0.28 | 0.21 | 0.20 |
| Maximum Pore Diameter (μm) | 29.4 | 28.5 | 26.9 | 73.2 | 29.2 | 58.3 |
| Tensile Strength/ Tensile Elongation (MD) [(kg/50 mm)/%] | 6.0/14 | 8.2/18 | 8.0/15 | 11.2/40 | 4.4/16 | 9.0/40 |
| Tensile Strength/ Tensile Elongation (TD) [(kg/50 mm)/%] | 4.4/62 | 5.9/75 | 6.2/60 | 4.0/45 | 5.0/97 | 3.2/45 |
| Retention Ratio of | 357 | 253 | 235 | 274 | 59 | 260 |

TABLE 5-continued

| | Example No. | | | Comparative Example No. | | |
|---|---|---|---|---|---|---|
| | 16 | 17 | 18 | 16 | 17 | 18 |
| 30% KOH Solution (%) | | | | | | |
| Electric Resistance ($\times 10^{-3}\ \Omega \cdot cm^2$ per each sheet) | 0.35 | 0.54 | 0.66 | 0.40 | 0.41 | 0.45 |

Note
*Parts by weight.
(1)Treated with a 0.8%-surfactant (sodium dodecylbenzene sulfonate) solution.
(2)Spun-bonded non-woven fabric.

As is clear from Table 5, the non-woven fabrics of Examples 16–18 have not only a high mechanical strength but also a small maximum pore diameter. Accordingly, the non-woven fabrics of the present invention have a high capability of preventing electrode active material particles from penetrating therethrough. In addition, the non-woven fabrics of Examples 16–18 show an improved retention ratio of an alkali solution. With respect to the electric resistance, those of Examples 16–18 are sufficiently low (lower than $0.9\times10^{-3}$ $\Omega\cdot cm^2$ per each sheet).

As described above in detail, since 100 parts by weight of the non-woven fabric having an apparent fiber diameter of 0.1–15 μm is coated with 0.3–10 parts by weight of an N-methylol or N-alkoxymethyl nylon resin and the N-methylol or N-alkoxymethyl nylon resin is cross-linked, the non-woven fabric of the present invention shows extremely improved strength. This means that if a battery separator is required to have the same strength, it would be made thinner when produced from the non-woven fabric of the present invention. This in turn leads to a smaller battery.

Particularly by using the N-methylol or N-alkoxymethyl nylon resin a hydrophilic vinyl monomer, the non-woven fabric can be provided with good hydrophilic nature.

Such high-strength non-woven fabrics of the present invention are suitable for battery separators. In addition, they may be used for artificial leathers, air filters, various sports wears, separators for medical applications, etc.

What is claimed is:

1. A high-strength non-woven fabric comprising 100 parts by weight of a non-woven fabric having an apparent fiber diameter of 0.1–15 μm; and 0.3–10 parts by weight of an N-methylol or N-alkoxymethyl nylon resin applied to said non-woven fabric, said N-methylol or N-alkoxymethyl nylon resin being cross-linked.

2. The high-strength non-woven fabric according to claim 1, wherein said N-methylol or N-alkoxymethyl nylon resin is one modified with a hydrophilic vinyl monomer.

3. The high-strength non-woven fabric according to claim 1, wherein said non-woven fabric is made of a polyamide resin.

4. The high-strength non-woven fabric according to claim 1, wherein said non-woven fabric is produced by a melt blowing method.

5. A method of producing a high-strength non-woven fabric comprising the steps of applying 0.3–10 parts by weight of an N-methylol or N-alkoxymethyl nylon resin in a solution state to 100 parts by weight of a non-woven fabric having an apparent fiber diameter of 0.1–15 μm; and drying and cross-linking said N-methylol or N-alkoxymethyl nylon resin.

6. The method according to claim 5, wherein the drying and cross-linking of said N-methylol or N-alkoxymethyl nylon resin is conducted at a temperature of 70°–200° C.

7. A battery separator constituted by a high-strength non-woven fabric comprising 100 parts by weight of a non-woven fabric having an apparent fiber diameter of 0.1–15 μm; and 0.3–10 parts by weight of an N-methylol or N-alkoxymethyl nylon resin applied to said non-woven fabric, said N-methylol or N-alkoxymethyl nylon resin being cross-linked.

8. The battery separator according to claim 7, wherein said N-methylol or N-alkoxymethyl nylon resin is one modified with a hydrophilic vinyl monomer.

9. The battery separator according to claim 7, wherein said non-woven fabric is made of a polyamide resin.

10. The battery separator according to claim 7, wherein said non-woven fabric is produced by a melt blowing method.

* * * * *